US008347902B2

(12) United States Patent
Baldwin

(10) Patent No.: US 8,347,902 B2
(45) Date of Patent: Jan. 8, 2013

(54) LEVER HANDLE MECHANISM FOR A DISHWASHER

(75) Inventor: Mark W. Baldwin, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 421 days.

(21) Appl. No.: 12/703,251

(22) Filed: Feb. 10, 2010

(65) Prior Publication Data

US 2011/0192430 A1 Aug. 11, 2011

(51) Int. Cl.
*B08B 3/02* (2006.01)

(52) U.S. Cl. ..... 134/200; 68/196

(58) Field of Classification Search ..... 68/12.26, 68/196; 134/57 DL, 58 DL; 292/251.5
See application file for complete search history.

(56) References Cited

U.S. PATENT DOCUMENTS

| | | | | |
|---|---|---|---|---|
| 2,659,115 | A * | 11/1953 | Anderson et al. | 49/277 |
| 3,027,217 | A * | 3/1962 | Gene | 312/276 |
| 4,412,710 | A | 11/1983 | Laprad et al. | |
| 5,174,618 | A | 12/1992 | Kropf | |
| 5,810,403 | A | 9/1998 | Prada | |
| 5,908,228 | A * | 6/1999 | Lee | 312/405 |
| 5,915,805 | A * | 6/1999 | Lee | 312/405 |
| 6,685,241 | B2 | 2/2004 | Bollmann | |
| 6,761,381 | B2 | 7/2004 | Prada et al. | |
| 6,893,061 | B2 | 5/2005 | Miller et al. | |
| 6,913,296 | B2 | 7/2005 | Bassi | |
| 7,089,948 | B2 | 8/2006 | DeBoer et al. | |
| 7,377,500 | B2 | 5/2008 | Tomiji et al. | |
| 7,552,738 | B2 | 6/2009 | Shin | |
| 7,562,914 | B2 * | 7/2009 | Bassi | 292/173 |
| 8,025,349 | B2 * | 9/2011 | Lim et al. | 312/405 |
| 2004/0163684 | A1 | 8/2004 | Hapke | |

FOREIGN PATENT DOCUMENTS

| | | | |
|---|---|---|---|
| DE | 33 01 636 | * | 7/1984 |
| JP | 09-137643 | * | 5/1997 |

* cited by examiner

*Primary Examiner* — Frankie L Stinson
(74) *Attorney, Agent, or Firm* — Jacquelyn R. Lin; Peter J. Melsa

(57) ABSTRACT

A dishwasher includes a tub, a door coupled to the tub, and a hand lever coupled to the door. The tub has an access opening that permits access to a washing chamber defined therein. The door has a closed position in which access to the washing chamber is prevented. When the door is positioned in the closed position, the rotation of the lever in a first direction about a laterally extending axis advances the lever into contact with the tub such that the door is urged away from the tub.

11 Claims, 3 Drawing Sheets

LEVER HANDLE MECHANISM FOR A DISHWASHER

TECHNICAL FIELD

The present disclosure relates generally to a dishwasher and more particularly to a lever handle mechanism for a door assembly of a dishwasher.

BACKGROUND

A dishwasher is a domestic appliance into which dishes and other cooking and eating wares (e.g., plates, bowls, glasses, flatware, pots, pans, bowls, etcetera) are placed to be washed. A dishwasher includes a tub having a number of dish racks onto which such wares are loaded. A hinged door provides user access to the dish racks located in the tub.

SUMMARY

According to one aspect, a dishwasher includes a tub defining a washing chamber having a number of dishwashing racks positioned therein. The tub has an opening defined in the front thereof to permit access to the number of dishwashing racks. The dishwasher also includes a door coupled to the tub. The door has a closed position in which the door prevents access to the number of dishwashing racks positioned in the washing chamber. A hand lever is pivotably coupled to the door, and the lever is configured to rotate about a laterally extending axis. When the door is positioned in the closed position, the rotation of the lever in a first direction about the axis advances the lever into contact with the tub such that the door is urged away from the tub.

In some embodiments, the lever may include a body having a first end and a second end. The first end may be formed as a handle sized to receive a hand of a user. The axis may be positioned between the first end and the second end.

In some embodiments, the lever may include at least one push rod contacting the second end of the body. The push rod may be configured to advance into contact with the tub when the lever is rotated in the first direction and the door is positioned in the closed position.

In some embodiments, the door may extend from an upper end to a lower end pivotably coupled to the tub. The door may include an inner panel configured to seal the access opening when the door is positioned in the closed position, and an outer panel that is positioned opposite the inner panel. The outer panel and the inner panel may define a door compartment therebetween.

Additionally, in some embodiments, the push rod may include a shaft extending from a first end to a second end. The shaft may extend through a hole formed in an upper wall of the inner panel such that the second end is positioned outside of the door compartment.

In some embodiments, when the door is positioned in the closed position, the rotation of the lever in the first direction may move the lever between a first position where the second end of the push rod is spaced apart from the tub, and a second position where the second end of the push rod is placed in contact with the tub. In some embodiments, a spring may be secured at a first end to the push rod and at a second end to the inner panel. The spring may bias the lever in the first position. In some embodiments, the handle of the lever may extend outwardly from the outer panel of the door when the lever is in placed in the second position.

Additionally, in some embodiments, the dishwasher may include a mounting bracket received in a slot formed in the outer panel of the door, and the lever may be pivotably coupled to the mounting bracket at a pivot joint. The pivot joint may have the axis extending therethrough.

According to another aspect, the dishwasher may include a frame and a tub secured to the frame. The tub has an access opening defined in the front thereof to permit access to a washing chamber defined therein. A door is pivotably coupled the frame, and the door has a closed position in which the door extends over the access opening such that access to the washing chamber is prevented. A hand lever is pivotably coupled to the door and includes a pair of push rods. When the door is positioned in the closed position, the rotation of the lever in a first direction about a laterally extending axis advances the pair of push rods into contact with the frame such that the door is urged away from the tub.

In some embodiments, the dishwasher may include a pair of springs. Each spring may be secured at a first end to one of the push rods and at a second end to the door. The pair of springs may bias the push rods such that the push rods are spaced apart from the frame when the door is positioned in the closed position.

In some embodiments, the lever may include a body pivotably coupled to the door at a pivot joint. The pivot joint may have the axis extending therethrough, and the pair of push rods may contact an upper end of the body. In some embodiments, the body may extend from the upper end to a lower end. The lower end may be formed as a handle sized to receive the hand of a user.

According to another aspect, a dishwasher includes a tub having an access opening defined in the front thereof to permit access to a washing chamber defined therein and a door coupled the tub. The door has a closed position in which access to the washing chamber is prevented. The dishwasher also includes a handle assembly pivotably coupled to the door. The handle assembly includes a mounting bracket coupled to the door and a lever pivotably coupled to the mounting bracket. When the door is positioned in the closed position, the rotation of the lever in a first direction about a laterally extending axis advances the lever into contact with the tub such that the door is urged away from the tub.

In some embodiments, the lever may include a handle positioned within a pocket formed in the mounting bracket. In some embodiments, the lever may include a pair of push rods configured to contact the tub when the lever is rotated in the first direction and the door is positioned in the closed position.

BRIEF DESCRIPTION OF THE DRAWINGS

The detailed description particularly refers to the following figures, in which.

DETAILED DESCRIPTION OF THE DRAWINGS

Figure 1:
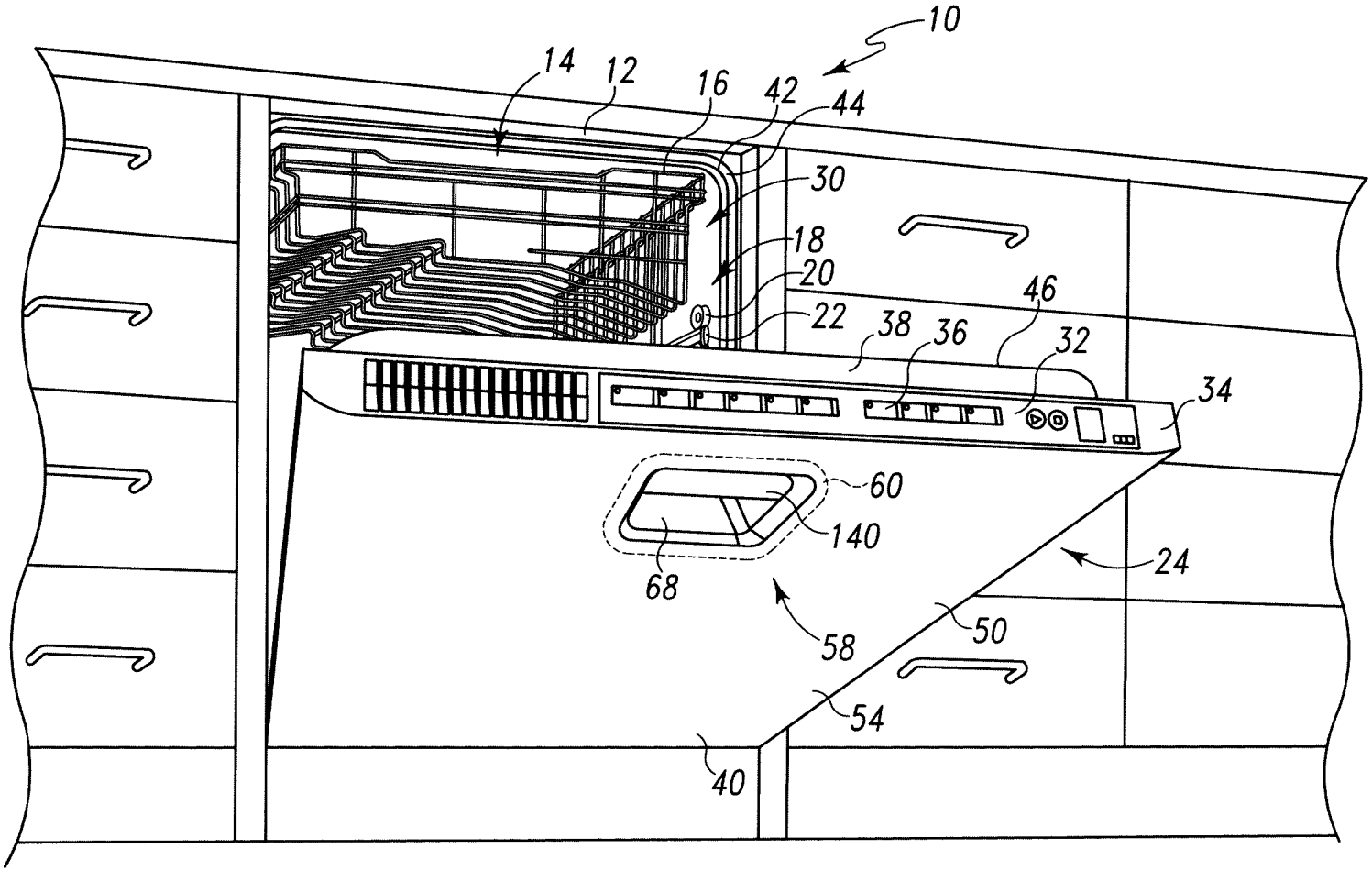
FIG. 1 is fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a dishwasher 10 having a tub 12 which defines a washing chamber 14 into which dishes and other cooking and eating wares (e.g., plates, bowls, glasses, flatware, pots, pans, bowls, etcetera) are placed to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from, and retract back into, the tub 12. Such movement facilitates the loading and unloading of the dish racks 16. The roller assemblies 18 include a number of rollers 20 that roll along the top of, and in some cases the top and bottom of, a corresponding support rail 22.

A door assembly 24 is hinged to the lower front edge of the tub 12. The door assembly 24 permits access to the tub 12 to load and unload the dishwasher 10. As shown in FIG. 1, the open front side of the tub 12 defines an access opening 30, which provides user access to the dish racks 16 positioned in the washing chamber 14. As used herein, the term "access opening" is intended to mean the opening formed in the front side of the tub through which a user of the dishwasher gains access to the dish racks to, for example, load and unload the same. As such, when the door assembly 24 is closed, user access to the dish racks 16 is prevented, whereas user access to the dish racks 16 is permitted when the door assembly 24 is open. The door assembly 24 also functions to seal the dishwasher 10 so that water does not escape the access opening 30 of the dishwasher 10 during a wash cycle.

A control panel 32 is located at an upper end 34 of the door assembly 24. The control panel 32 includes a number of controls 36, such as buttons and status indicators, that are used to control operation of the dishwasher 10. The user may access the control panel 32 when the door assembly 24 is open; when the door assembly 24 is closed, the control panel 32 is hidden beneath the kitchen countertop and therefore unaccessible.

An inner door panel 38 extends downwardly from the upper end 34 of the door assembly 24 to a lower end 40. The inner door panel 38 engages an interior wall 42 of the tub 12 to seal the entire access opening 30 when the door assembly 24 is closed. A number of seals 44 (see FIGS. 3 and 4) are positioned between a rear surface 46 of the inner door panel 38 and the interior wall 42 of the tub 12 to facilitate such a sealing arrangement. As shown in FIG. 1, the lower end 40 of the door assembly 24 pivots relative to the lower edge of the tub 12. It should be appreciated that the inner door panel 38 may be secured to the lower front edge of the tub 12 via a number of hinges (not shown) configured to pivot the door assembly 24 in such a manner.

Figure 3:
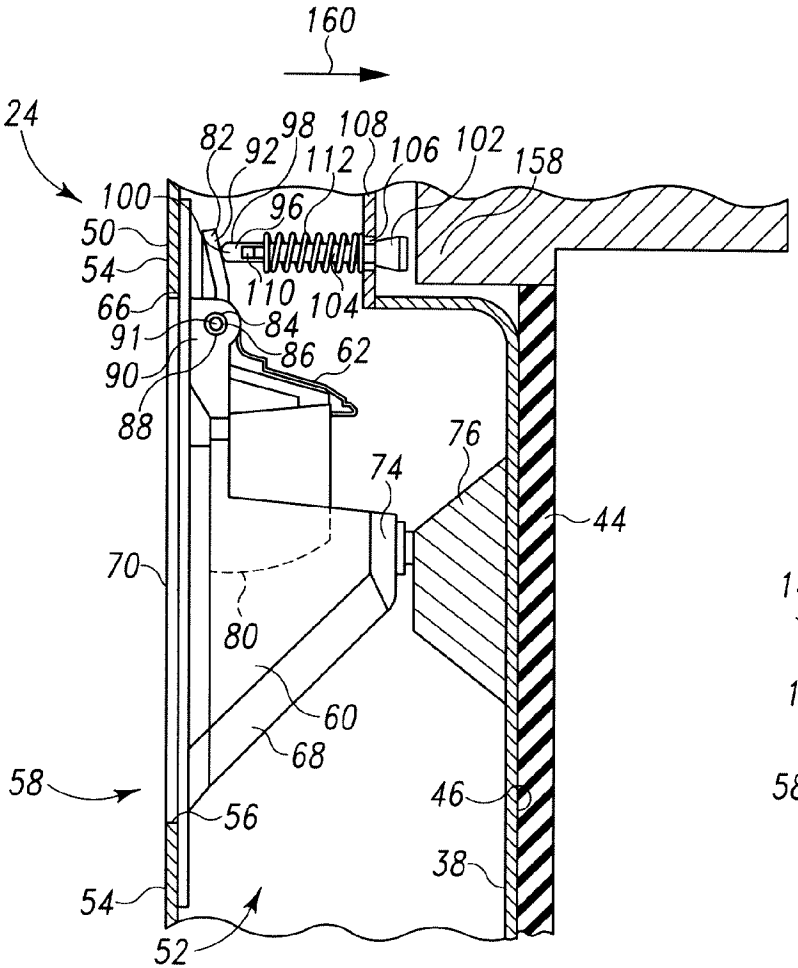
FIG. 3 is a diagrammatic side elevation view showing the lever handle assembly of FIG. 2 positioned in one position.

An outer door panel 50 extends downwardly from the upper end 34 of the door assembly 24. When the door assembly 24 is opened, the outer door panel 50 tips outwardly along with the inner door panel 38. As shown in FIG. 3, the outer door panel 50 is spaced apart from the inner door panel 38 such that a door compartment 52 is defined therebetween (see FIGS. 3 and 4). The outer door panel 50 includes a front wall 54 that faces outward from the front of the dishwasher 10. The front wall 54 has a slot 56 formed therein that opens into the door compartment 52. A handle assembly 58 is received in the slot 56 (see FIG. 3). As described in greater detail below, a user may use the handle assembly 58 to open the door assembly 24.

Figure 2:
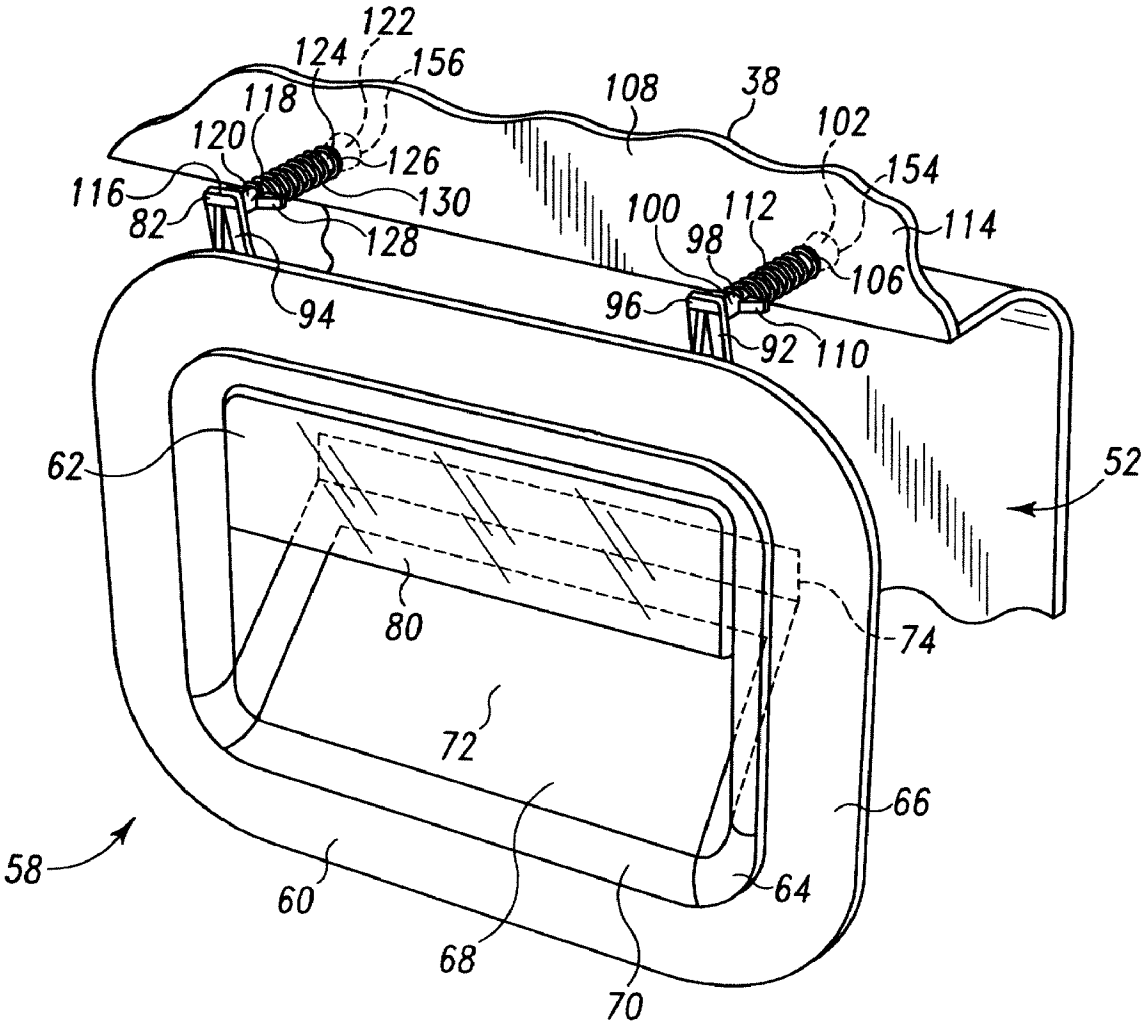
FIG. 2 is a fragmentary perspective view of the lever assembly of the dishwasher of FIG. 1.
Figure 4:
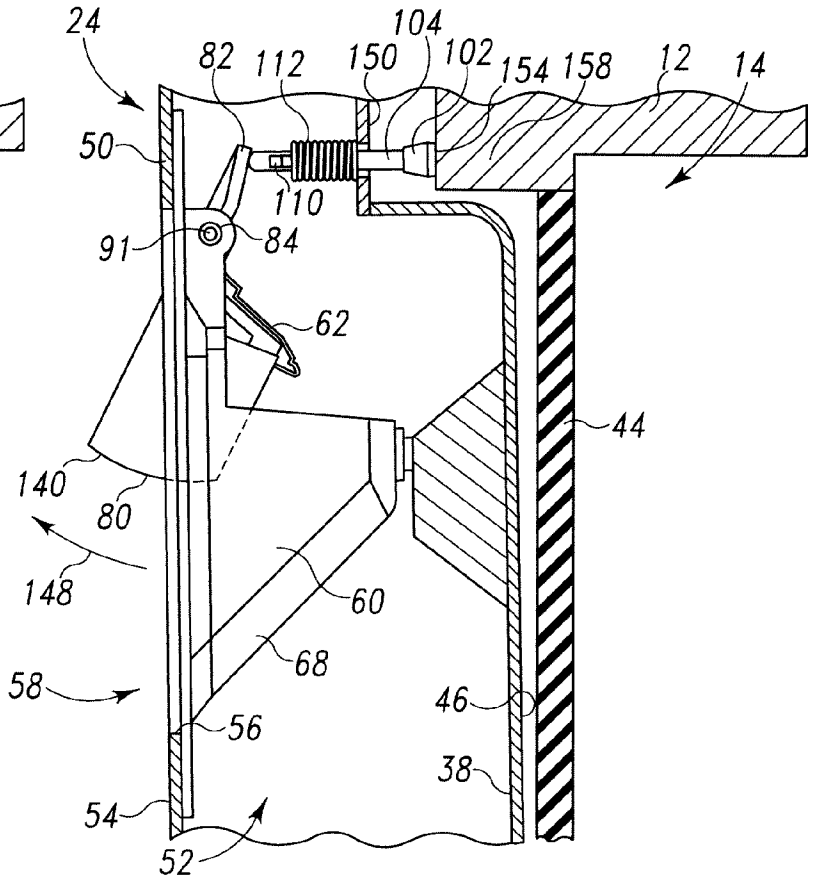
FIG. 4 is a diagrammatic side elevation view showing the lever handle assembly of FIG. 2 positioned in another position.

Referring now to FIG. 2-4, the handle assembly 58 is shown in additional detail. The handle assembly 58 includes a mounting bracket 60 and a lever body 62 pivotably coupled to the mounting bracket 60. The mounting bracket 60 includes a housing 64 that is received in the slot 56 formed in the outer door panel 50. The mounting bracket 60 also includes an inner flange 66 that contacts the front wall 54. A front end 70 of the housing 64 is flush with the front wall 54 of the outer door panel 50. It will be appreciated that in other embodiments the inner flange may be removed and another flange may be added, which extends outwardly from the front end 70 of the housing 64 and contacts the outer surface of the front wall 54 of the outer door panel 50.

The housing 64 has a pocket 68 defined therein that extends rearwardly from the front end 70 of the housing 64 to a back surface 72 of an end 74 of the housing 64. As shown in FIG. 2, a portion of the back surface 72 is sloped relative to the front of the housing 64 such that the top of the pocket 68 has a greater depth than the bottom of the pocket 68. The handle assembly 58 is secured to the door assembly 24 via a screw or other fastener (not shown), which couples the end 74 of the mounting bracket 60 to the inner bracket 76 of the door assembly 24.

The lever body 62 of the handle assembly 58 extends from a lower end 80 to an upper end 82. The lever body 62 is coupled to the housing 64 at a pair of pivot joints 84 (see FIG. 3) positioned between the upper end 82 and the lower end 80. Each pivot joint 84 includes a cylindrical pivot pin 86 that extends outwardly from the lever body 62. The pivot pin 86 is received in a corresponding hole 88 defined in a side wall 90 of the housing 64. As shown in FIGS. 3 and 4, the lever body 62 is configured to rotate about a laterally extending axis 91 defined by the pivot joints 84.

The lever body 62 includes a pair of arms 92, 94 extending upwardly from the pivot joints 84 to the upper end 82. As shown in FIGS. 3 and 4, the arms 92, 94 are positioned within the door compartment 52 between the inner door panel 38 and the outer door panel 50. The arm 92 includes a tip 96 positioned above the housing 64 of the mounting bracket 60. A push rod 98 contacts the tip 96 of the arm 92 at an end 100, and the push rod 98 extends from the end 100 to another end 102. A shaft 104 of the push rod 98 extends through a hole 106 formed in an upper wall 108 of the inner door panel 38 such that the end 102 of the push rod 98 is positioned outside of the door compartment 52.

A pair of tabs 110 extends outwardly from the shaft 104 of the push rod 98, and a spring 112 extends over the shaft 104 between the pair of tabs 110 and an interior surface 114 of the upper wall 108 of the inner door panel 38. As the lever body 62 rotates about the axis 91, the shaft 104 slides back and forth in the hole 106. The movement of the shaft 104 changes the position of the tabs 110 relative to the upper wall 108 of the inner door panel 38 such that the spring 112 is compressed or expanded therebetween as the lever body 62 rotates about the axis 91.

As shown in FIG. 2, the other arm 94 of lever body 62 also includes a tip 116 positioned above the housing 64 of the mounting bracket 60. A push rod 118 contacts the tip 116 of the arm 94 at an end 120, and the push rod 118 extends from the end 120 to another end 122. A shaft 124 of the push rod 118 extends through a hole 126 formed in the upper wall 108 such that the end 122 of the push rod 118 is positioned outside of the door compartment 52.

The shaft 124 of the push rod 118 also includes a pair of tabs 128 extending outwardly therefrom. A spring 130 extends over the shaft 124 between the pair of tabs 128 and the interior surface 114 of the upper wall 108 of the inner door panel 38. As the lever body 62 rotates about the axis 91, the shaft 124, like the shaft 104 of the push rod 98, slides back and forth in the hole 126. The movement of the shaft 124 changes the position of the tabs 128 relative to the upper wall 108 such that the spring 130 is compressed or expanded therebetween as the lever body 62 rotates about the axis 91.

As shown in FIG. 2, the lower end 80 of the lever body 62 is positioned within the pocket 68 of the mounting bracket 60. The lower end 80 is shaped as a handle 140 configured to be grasped by a user. The handle 140 is positioned within the pocket 68 such that only a portion of the back surface 72 is visible from the front of the dishwasher 10. The handle 140 is operable by the user to rotate the lever body 62 of the handle assembly 58 about the axis 91 in the direction indicated by arrow 148 (see FIGS. 3 and 4). As the user rotates the lever body 62, the handle 140 extends outwardly from the pocket 68 of the mounting bracket 60 and the front wall 54 of the outer door panel 50.

As shown in FIGS. 3 and 4, when the user grasps the handle 140 and pulls it in the direction indicated by arrow 148, the springs 112, 130 are compressed between the tabs 110, 128 and the upper wall 108 of the inner door panel 38. The shafts 104, 124 of the push rods 98, 118 slide within the holes 106, 126 in the direction indicated by arrow 160 such that the ends 102, 122 of the push rods 98, 118 move away from an exterior surface 150 of the upper wall 108 of the inner door panel 38. When the door assembly 24 is closed, the movement of the push rods 98, 118 advance bottom surfaces 154, 156 of the ends 102, 122 into contact with upper frame 158 of the tub 12. The bottom surfaces 154, 156 engage the upper frame 158 and urge the door assembly 24 away from the tub 12, thereby opening the door assembly 24. In that way, the push rods 98, 118 of the handle assembly 58 provide the user with mechanical assistance when the user is first opening the door assembly.

As the user pulls the door assembly 24 away from the tub 12, the push rods 98, 118 move out of contact with the upper frame 158. When the user releases the handle 140, the springs 112, 130 urge the tabs 110, 128 away from the upper wall 108 of the inner door panel 38 and thereby cause the lever body 62 to rotate in the opposite direction. As the lever body 62 rotates, the handle 140 moves back into position within the pocket 68 of the mounting bracket 60

As will be appreciated by those of the skill in the art, the dishwasher 10 may include elements other than those shown and described above. For example, in one embodiment, a torsion spring may be positioned between the lever body 62 and the mounting bracket 60. In such an embodiment, the torsion spring would be configured to compress when user rotates the lever body 62 in the direction indicated by arrow 148 and urge the lever body 62 to reverse direction after the handle 140 is released. In such embodiments, the torsion spring might supplement, or eliminate, the springs 112, 130 shown in the illustrative embodiment.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A dishwasher comprising:

a tub defining a washing chamber having a number of dishwashing racks positioned therein, the tub having an access opening defined in a front thereof to permit access to the number of dishwashing racks, a door coupled to the tub, the door having a closed position in which the door prevents access to the number of dishwashing racks positioned in the washing chamber, and a hand lever pivotably coupled to the door, the lever being configured to rotate about a laterally extending axis, wherein when the door is positioned in the closed position, the rotation of the lever in a first direction about the axis advances the lever into contact with the tub such that the door is urged away from the tub, wherein the hand lever includes a body having a first end and a second end, the first end being formed as a handle sized to receive a hand of a user, wherein the axis is positioned between the first end and the second end, wherein, when the door is positioned in the closed position, the rotation of the hand lever in the first direction moves the hand lever between a first position where a surface of the first end is substantially flush with a surface of the door and a second position where the first end is rotated outward from the surface of the door, and wherein the door has a recess defined therein to receive the hand of the user when the hand lever is in the first position.

2. The dishwasher of claim 1, wherein the hand lever includes at least one push rod contacting the second end of the body, the push rod being configured to advance into contact with the tub when the hand lever is rotated in the first direction and the door is positioned in the closed position.

3. The dishwasher of claim 2, wherein the door extends from an upper end to a lower end pivotably coupled to the tub, the door including:

an inner panel configured to seal the access opening when the door is positioned in the closed position, and an outer panel positioned opposite the inner panel, the outer panel and the inner panel defining a door compartment therebetween.

4. The dishwasher of claim 3, wherein:

the push rod includes a shaft extending from a first end to a second end, and the shaft extends through a hole formed in an upper wall of the inner panel such that the second end is positioned outside of the door compartment.

5. The dishwasher of claim 4, wherein (i) in the first position the second end of the push rod is spaced apart from the tub, and (ii) in the second position the second end of the push rod is placed in contact with the tub.

6. The dishwasher of claim 5, further comprising a spring secured at a first end to the push rod and at a second end to the inner panel, wherein the spring biases the lever in the first position.

7. The dishwasher of claim 3, further comprising:

a mounting bracket received in a slot formed in the outer panel of the door, wherein the hand lever is pivotably coupled to the mounting bracket at a pivot joint, the pivot joint having the axis extending therethrough.

8. A dishwasher comprising:

a frame, a tub secured to the frame, the tub having an access opening defined in a front thereof to permit access to a washing chamber defined therein, a door pivotably coupled the frame, the door having a closed position in which the door extends over the access opening such that access to the washing chamber is prevented, and a hand lever pivotably coupled to the door, the hand lever including a pair of push rods, wherein when the door is positioned in the closed position, the rotation of the hand lever in a first direction about a laterally extending axis advances the pair of push rods into contact with the frame such that the door is urged away from the tub, wherein the hand lever includes a body having a first end and a second end, the first end being formed as a handle sized to receive a hand of a user, the second end contacting the pair of push rods, wherein the axis is positioned between the first end and the second end, wherein, when the door is positioned in the closed position, the rotation of the hand lever in the first direction moves the hand lever between a first position where a surface of the first end is substantially flush with a surface of the door and a second position where the first end is rotated outward from the surface of the door, and wherein the door has a recess defined therein to receive the hand of the user when the hand lever is in the first position.

9. The dishwasher of claim 8, further comprising a pair of springs, each spring being secured at a first end to one of the push rods and at a second end to the door, wherein the pair of springs bias the push rods such that the push rods are spaced apart from the frame when the door is positioned in the closed position.

10. A dishwasher comprising:

a tub, the tub having an access opening defined in a front thereof to permit access to a washing chamber defined therein, a door coupled the tub, the door having a closed position in which access to the washing chamber is prevented, and a handle assembly pivotably coupled to the door, the handle assembly including a mounting bracket coupled to the door and a lever pivotably coupled to the mounting bracket, wherein when the door is positioned in the closed position, the rotation of the lever in a first direction about a laterally extending axis advances the lever into contact with the tub such that the door is urged away from the tub, wherein the lever includes a body having a first end and a second end, the first end being formed as a handle sized to receive a hand of a user, the second end contacting a pair of push rods, wherein the axis is positioned between the first end and the second end, wherein, when the door is positioned in the closed position, the rotation of the lever in the first direction moves the lever between a first position where a surface of the first end is substantially flush with a surface of the door and a second position where the first end is rotated outward from the surface of the door, and wherein the door has a recess defined therein to receive the hand of the user when the lever is in the first position.

11. The dishwasher of claim 10, wherein the lever includes the pair of push rods, the push rods being configured to contact the tub when the lever is rotated in the first direction and the door is positioned in the closed position.

* * * * *